United States Patent [19]

Pugh

[11] Patent Number: 4,883,301

[45] Date of Patent: Nov. 28, 1989

[54] CUSHION FOR A PERSONNEL/CARGO NET

[75] Inventor: Billy G. Pugh, Corpus Christi, Tex.

[73] Assignee: Billy Pugh Company, Inc., Corpus Christi, Tex.

[21] Appl. No.: 226,884

[22] Filed: Aug. 1, 1988

[51] Int. Cl.[4] ..... B66C 1/16

[52] U.S. Cl. ..... 294/77; 267/140; 441/83

[58] Field of Search ..... 294/77; 441/40, 131, 441/83; 244/138, 138 R; 114/219; 293/107, 108, 110; 267/140; 182/138, 139

[56] References Cited

U.S. PATENT DOCUMENTS

| | | | |
|---|---|---|---|
| 2,712,913 | 7/1955 | Stanely | 293/107 |
| 3,266,757 | 8/1966 | Guiene | 244/138 R |
| 3,371,894 | 3/1968 | Hartnell-Beavis | 248/631 |
| 3,827,745 | 8/1974 | Pugh | 294/77 |
| 4,560,136 | 12/1985 | Basore | 248/559 |

FOREIGN PATENT DOCUMENTS

| | | | |
|---|---|---|---|
| 1456169 | 5/1965 | Fed. Rep. of Germany . | |
| 1109606 | 2/1956 | France | 182/139 |

*Primary Examiner*—Johnny D. Cherry
*Assistant Examiner*—V. Nishanian
*Attorney, Agent, or Firm*—Stevens, Davis, Miller & Mosher

[57] ABSTRACT

Additional shock absorbing structure composed of separate fluid filled rubber tubes disposed on a base spreader ring of a personnel/cargo net for absorbing shock on landing to prevent injuries to passengers on the net.

7 Claims, 2 Drawing Sheets

10
12
14
16
18
20
21
22
23
24
25
26
28
30
32
34
36
45
46

CUSHION FOR A PERSONNEL/CARGO NET

FIELD OF THE INVENTION

This invention relates generally to a personnel/cargo net, and more particularly to an improved safety cushion integral with the bottom spreader ring of the net.

BACKGROUND OF THE INVENTION

Personnel/cargo nets have been used extensively by the offshore oil-drilling industry to transfer personnel and cargo between boats and offshore oil rigs. The Billy Pugh Co. of Corpus Christi, Texas manufactures the most commercially acceptable personnel/cargo net in the industry. The Billy Pugh personnel/cargo net is disclosed and claimed in U.S. Pat. No. 3,827,745 which is herein incorporated by reference.

Personnel/cargo nets are constructed generally of a top spreader ring, and a bottom spreader ring with rope lattice-work between the rings. The bottom spreader ring has a rope lattice base and a cushioning device. Personnel being transferred from ships to oil rigs stand on the cushion while holding onto the lattice work of the net. Such nets have served the oil industry well.

In recent years the price of oil has become depressed, and the uncertainty in the market has led to a large turnover of oil-rig employees. New employees are unfamiliar with the oil-rig environment and their lack of experience manifests itself in the type of injuries they sustain in being transferred from rig to boat, or vice versa, with personnel/cargo nets.

It is therefore an object of the invention to include structure in the base spreader ring of a personnel/cargo net to reduce the number of injuries occurring in using such nets.

SUMMARY OF THE INVENTION

The invention relates to a shock absorbing structure composed of separate fluid containing shock absorbing means disposed on a base spreader ring of a personnel/-cargo net for absorbing shock on landing to prevent injuries to passengers on the net.

DETAILED DESCRIPTION OF THE INVENTION

Figures 1, 2, 5:
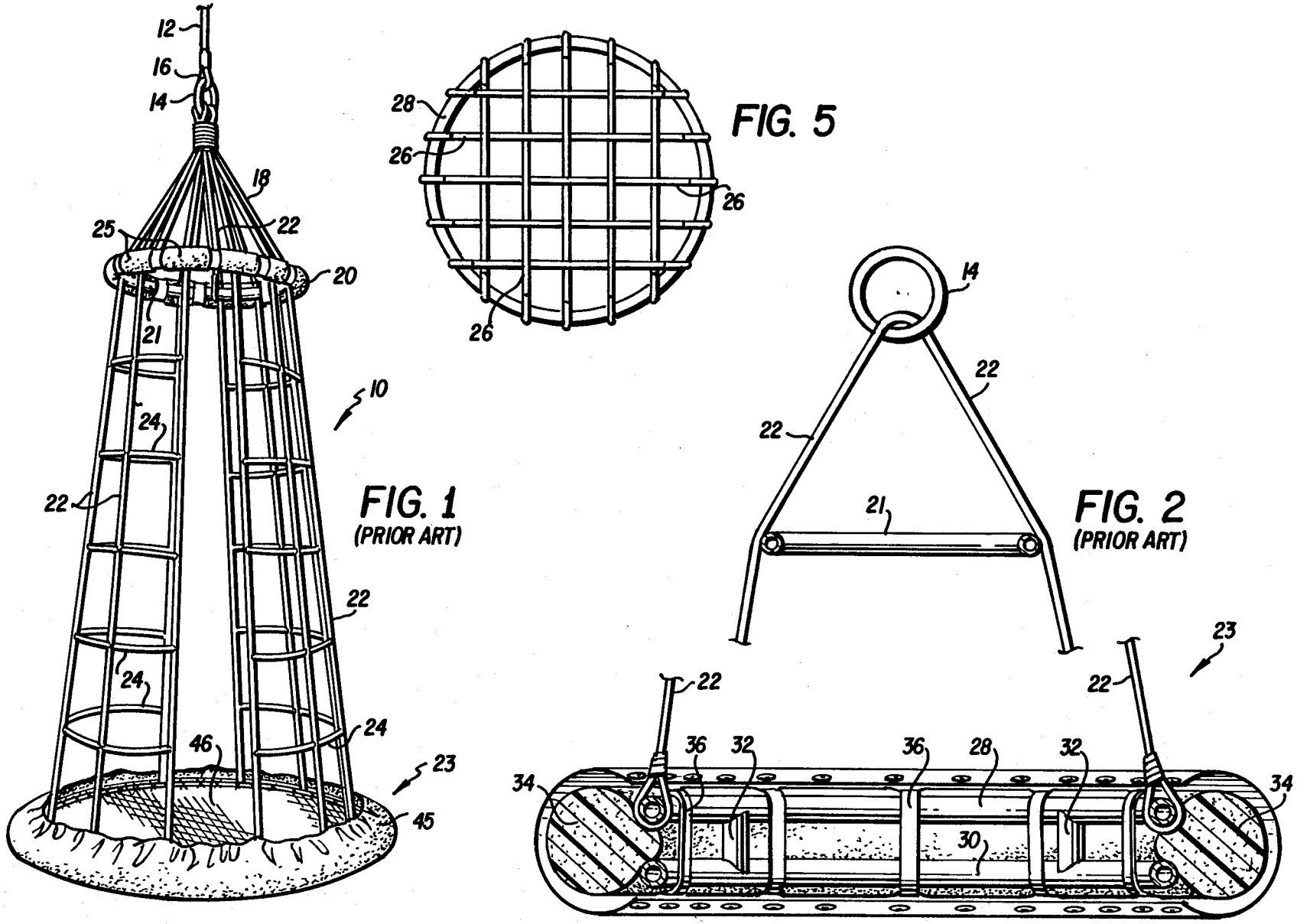
FIG. 1 (PRIOR ART)
FIG. 2 (PRIOR ART)
FIG. 1 is a perspective view of a prior art personnel/-cargo net.
FIG. 2 is a diagrammatic side elevation, partially in section, illustrating the prior art base spreader ring heretofore used in the personnel/cargo net of FIG. 1.
FIG. 5 is a plan view of an uncovered base spreader ring and its integral load supporting platform.

Referring now to the drawings a personnel/cargo net 10 is illustrated in FIG. 1. Net 10 is connected to a hoist or winch (not shown) by an inelastic cable 12. Cable 12 is connected to net 10 by being secured to pick-up ring 14 by eyelet 16.

Suspended from pick-up ring 14 by lacings or ropes 18 is a top spreader ring 20. Top spreader ring 20 is composed of a steel ring 21 (FIG. 2) and a cushion 25 surrounding the ring 14. Second lacings or ropes 22, being circumferentially spaced relative to one another and extending in the downward longitudinal direction relative to pick-up ring 14, are connected at their first ends to pick-up ring 14 and at their second ends to structure of base spreader ring 23 described below. Horizontal lacings or ropes 24 combine with lacings 22 to form a web-like or lattice-work side wall for the net. Lacings 24 do not extend completely about net 10 so that an opening is provided for access to the interior of net 10.

Base spreader ring 23 is larger in diameter than top spreader ring 20 to encourage passengers to lean into the net when being ferried.

Figure 3:
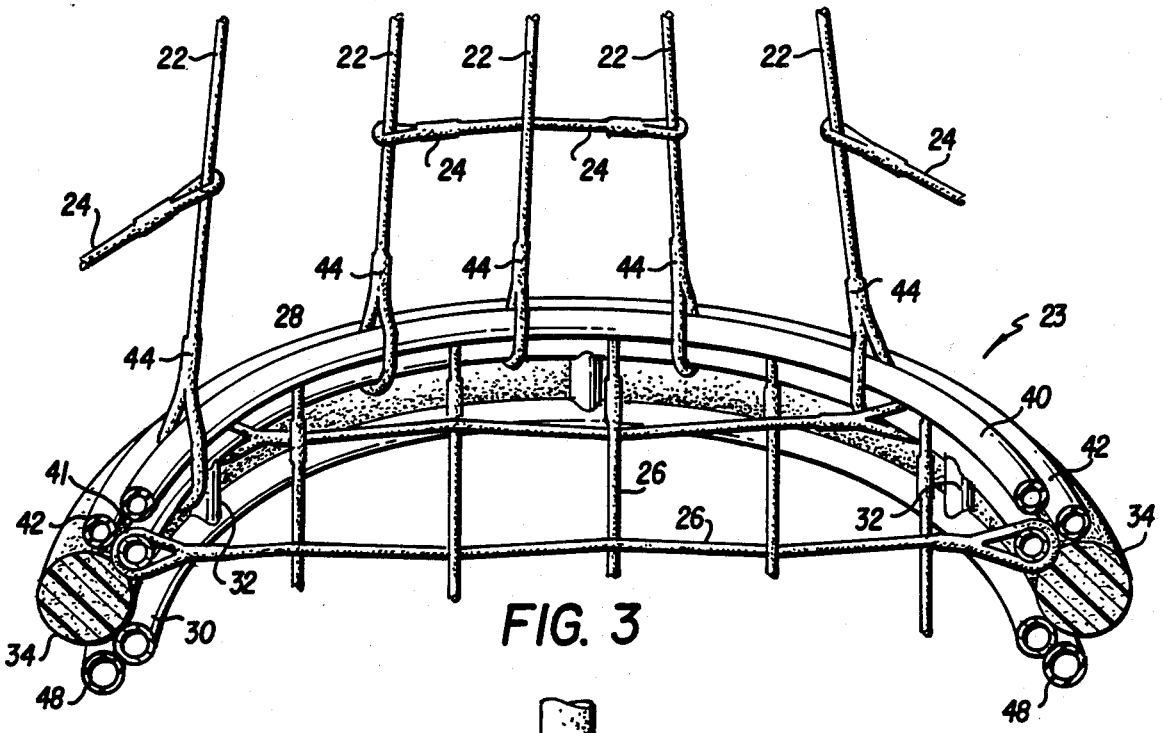
FIG. 3 is a diagrammatic side elevation, partially in section, illustrating the safety improvement of the claimed invention.

As shown in FIG. 2 the prior art base spreader ring 23 is formed of two steel rings, top ring 28 and bottom ring 30. Lacings 22 are connected at their second ends to top ring 28 as shown in FIGS. 2 and 3. Rings 28 and 30 are of substantially the same diameter and they are secured in vertically spaced relationship by circumferentially spaced bars 32. The ends of bars 32 may be welded or otherwise secured to rings 28 and 30. A foam plastic or rubber buoyant pad 34 is disposed about the periphery of rings 28 and 30. Circumferentially spaced annular steel bands 36 secure pad 34 to rings 28 and 30 and the steel bands may force a portion of the pad 34 into the groove between rings 28 and 30 as shown. Pad 34 may be any suitable buoyant and cushioning material.

As shown in FIG. 5, the area enclosed by base spreader ring 23 is closed by a network of chordal ropes 26 secured at each end to a top ring 28 of base spreader ring 23.

The instant invention includes all of the structure recited above. Although the prior art base spreader ring is a padded structure which serves to protect a passenger in the event of a hard landing, this prior art base spreader cannot fully protect inexperienced employees against landing-shock, and thus injury, and additional padding, or a second cushion, is required to prevent injury of such an inexperienced passenger.

In a first embodiment of the invention the additional padding or cushion device is a set of hollow rubber tubes 40 and 42 filled with a fluid such as a liquid or gas.

Figure 4:
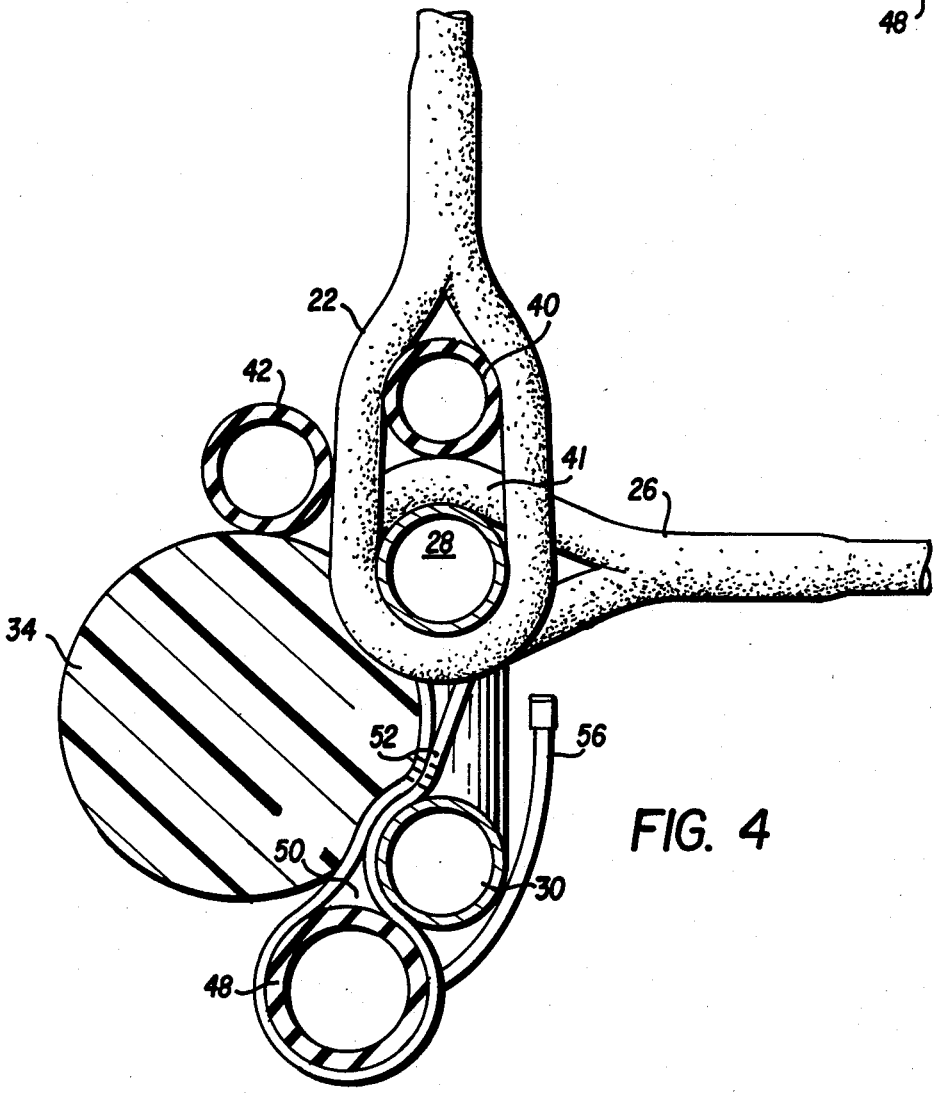
FIG. 4 is the left end of FIG. 3 enlarged to dimensions slightly less than the actual dimensions of the net, but drawn to scale.

As shown in FIGS. 3 and 4 rubber tube 40 is circular in cross section and is positioned above top ring 28 and seated on top of eyes 41 of chordal ropes or lacings 26. As seen in FIG. 3 rubber tube 40 is maintained in this position by ropes or lacings 22, the end of each lacing 22 is looped about top ring 28, and then spliced back onto the lacing as shown at 44. Rubber tube 40 is filled with a fluid, such as compressed air, and the rubber tube 40 may have a valve and valve stem (not shown) for adjusting the amount of fluid supplied to it.

A second rubber tube 42 is positioned about the outside circumference of top ring 28 and rubber tube 40. As shown a rubber tube 42 is separated from top ring 28 by the thickness of lacings 22. As shown in FIGS. 3 and 4 rubber tube 42 is seated on top of buoyant pad 34 and circumferentially surrounds lacings 22. Rubber tube 42 may also have a valve stem and valve for regulating the amount of fluid supplied to it.

As shown, rubber tubes 40 and 42 are spaced a short distance from one another so that a person being transported is able to engage both rubber tubes 40 and 42 with the soles of his shoes. Rubber tubes 40 and 42 may be covered with a nylon-vinyl blend cover, or canvas to protect the tubes from wear.

Buoyant pad 34 and rubber tubes 40 and 42 are enclosed by a cover 45 lashed about top and bottom rings 28 and 30, and to a canvas pad 46 disposed over chordal ropes 26 to form a platform for personnel/cargo net 10.

In a second embodiment, as shown in FIGS. 3 and 4, a third rubber tube 48, having an inner circumference slightly larger than the outer circumference of rings 28 and 30 is disposed in gap 50 between pad 34 and bottom ring 30.

This third rubber tube can be used as added cushioning and as a means for preventing damage to the underside of the base spreader ring 34.

Rubber tube 48 is secured to base spreader ring 23 by straps 52 which are looped around ring 48 and the ends of the straps are strung between buoyant pad 54 and bottom ring 30. Rubber tube 48 is also filled with a fluid such as a gas, through its valve stem 56 shown in FIG. 4.

Although the invention has been described in detail for the purpose of illustration, it is to be understood that such detail is solely for that purpose, and that variations can be made therein by those skilled in the art without departing from the spirit and scope of the invention except as it may be limited by the claims.

What is claimed is:

1. In a personnel/cargo net having at least one spreader ring, and said at least one spreader ring is a base spreader ring comprising top and bottom rings secured together in a vertically spaced relationship, and a buoyant pad surrounding each of said top and bottom rings, wherein the improvement comprises, at least one separate fluid-containing shock absorbing means for absorbing landing-or collision-shock experienced by the base spreader ring, and being located above said buoyant pad.

2. The personnel/cargo net of claim 1 wherein said fluid-containing shock absorbing means comprises at least one rubber tube filled with fluid and being aligned above said top ring.

3. The personnel/cargo net of claim 2 wherein the diameter of the rubber tube is substantially equal to the diameter of the top ring.

4. The personnel/cargo net of claim 2 further comprising a second rubber tube having a diameter greater than at least said one rubber tube and being positioned on a top portion of said buoyant pad.

5. The personnel/cargo net of claim 4 wherein said rubber tubes have means for adding to, and removing fluid from said rubber tubes.

6. The device of claim 2 further comprising a rubber tube having a circumference and diameter larger than said top and bottom rings and being positioned on the underside of said base spreader ring.

7. In a personnel/cargo net having at least one spreader ring, said at least one spreader ring is a base spreader ring comprising top and bottom rings secured together in a vertically spaced relationship, and a buoyant pad surrounding each of said top and bottom rings, wherein the improvement comprises, first, second and third fluid-containing rubber tubes positioned on said base spreader ring, said first rubber tube being of essentially the same diameter as said top and bottom rings and superimposed above said top ring; said second tube having a diameter larger than said first tube and being positioned on a top portion of said buoyant pad, and said third tube being secured to the underside of said base spreader ring.

* * * * *